US005144904A

United States Patent [19]

Weldon

[11] Patent Number: 5,144,904

[45] Date of Patent: Sep. 8, 1992

[54] STABILIZING APPARATUS

[75] Inventor: Jeffrey W. Weldon, Queensland, Australia

[73] Assignee: Ocean Torque Patent Pty. Ltd., Paradise Waters, Australia

[21] Appl. No.: 662,230

[22] Filed: Feb. 28, 1991

[51] Int. Cl.[5] ..... B63B 39/00

[52] U.S. Cl. ..... 114/311; 114/293; 114/360; 114/122

[58] Field of Search ..... 114/144 R, 360, 144 B, 114/311, 312, 293, 294, 121, 122; 244/110 D, 139, 140

[56] References Cited

U.S. PATENT DOCUMENTS

| | | | |
|---|---|---|---|
| 717,890 | 1/1903 | Miller | 114/311 |
| 728,330 | 5/1907 | Temperley | 114/311 |
| 1,096,192 | 5/1914 | Pleva | 114/121 |
| 3,029,767 | 4/1962 | Donnan | 114/311 |
| 3,034,613 | 11/1962 | Hubick | 114/311 |
| 3,039,419 | 6/1962 | Rimar | 114/311 |
| 3,589,324 | 6/1971 | Hoffman | 114/62 |

FOREIGN PATENT DOCUMENTS

| | | | |
|---|---|---|---|
| 488729 | 7/1928 | Fed. Rep. of Germany | 114/122 |

*Primary Examiner*—Joseph F. Peters, Jr.
*Assistant Examiner*—Clifford T. Bartz
*Attorney, Agent, or Firm*—Murray Schaffer; Jerome Bauer

[57] ABSTRACT

Stabilizing apparatus for stabilizing boats comprising a weighted concave body which is suspended from the boat and which is formed as a grid defining openings through the body and a flexible flap in the concavity of the body, the flap blocking the openings when the body rises in the water due to rolling of the boat so as to inhibit rolling and the flap moving away from the openings to permit the apparatus to rapidly fall as the boat rolls in the opposite direction. A pair of bodies are provided on opposite sides of the boat to inhibit rolling in both directions.

24 Claims, 4 Drawing Sheets

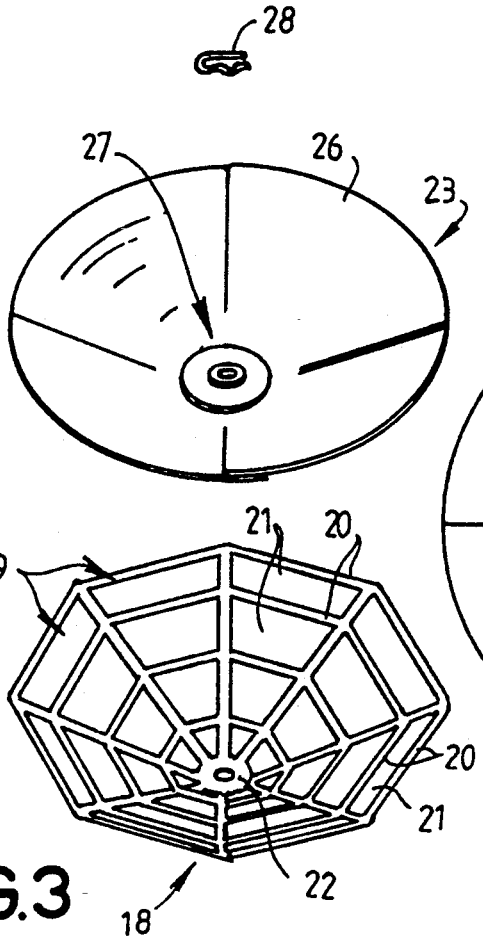
FIG.3
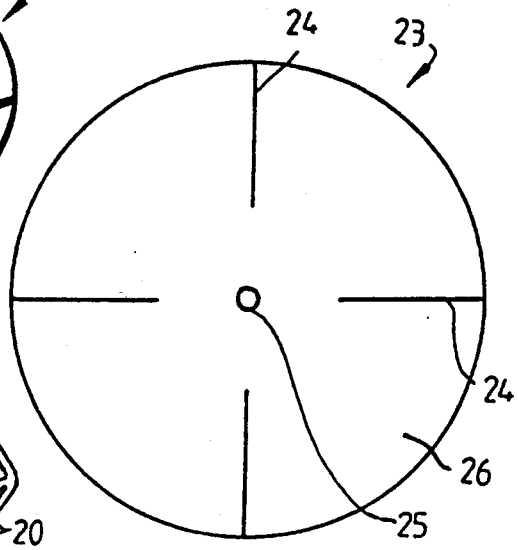
FIG.4
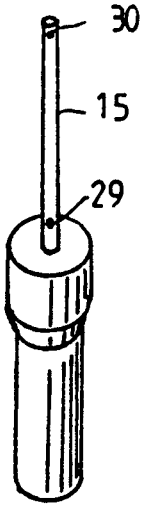

STABILIZING APPARATUS

FIELD OF THE INVENTION

This invention relates to stabilizing apparatus and in particular to apparatus for use with small or relatively small watercraft to prevent or reduce rolling or other undesired movement when such craft is anchored, moored or is drifting.

DESCRIPTION OF RELATIVE ART

Small or relatively small watercraft when used in areas where a swell or chop is generated often tend to pitch and roll due primarily to their relatively light weight construction or the design of their hulls. Such motions are particularly accentuated when such craft are used offshore and thus subject to ocean swells. Accordingly in rough weather, use of small watercraft offshore is limited either because excess pitching or rolling of the craft makes it uncomfortable for the occupants, for example where fishing is undertaken or because such motions make it unsafe for small watercraft to venture and/or anchor offshore.

SUMMARY OF THE INVENTION

The present invention aims to overcome or alleviate the above disadvantages by providing apparatus which may be used with small or relatively small watercraft to reduce pitching or rolling thereof. The present invention also aims to provide apparatus which may be easily stowed when not in use. Other objects and advantages of the invention will become apparent from the following description.

With the above and other objects in view, the present invention provides apparatus for stabilizing a watercraft, said apparatus including a submergible body assembly adapted to be suspended from said watercraft, said body assembly including body means having a plurality of openings therein, closure means on the operative upper side of said body means and adapted to close said openings to prevent liquid flow through said body means upon movement of said body means in a first direction whereby to damp in use movement of said watercraft, said closure means moving away from said openings to permit flow of liquid through said body means upon movement of said body means in a direction opposite said first direction.

Suitably, said body means defines on one side a concavity, said closure means comprising flexible flap means adapted for location within said cavity. Preferably said body means comprises a grid-like structure said grid-like structure defining said openings in said body means. Most preferably, said grid-like structure is defined by a plurality of grid panels, each said grid panel having a plurality of parallel elements defining said openings therebetween. The body assembly is also suitably weighted whereby to normally urge said body assembly in said opposite direction.

In one preferred form, said body assembly includes a central spindle, weight means at one end of said spindle and means at the opposite end of said spindle for coupling said body assembly to a tether whereby said body assembly may be suspended from said watercraft.

Resilient means are also suitably provided between said watercraft and said body assembly for dampening shock loadings applied to said body assembly.

The apparatus may also include an arm assembly adapted to be mounted to said watercraft to extend laterally thereof, said body assembly being suspended in use from said arm assembly.

The present invention also provides a watercraft including stabilizing apparatus of the type described above.

BRIEF DESCRIPTION OF THE DRAWINGS

In order that the invention may be more readily understood and put into practical effect, reference will now be made to the accompanying drawings which illustrate a preferred embodiment of the invention and wherein:

FIG. 3 is an exploded view of the submersible body assembly of FIG. 2;

FIG. 4 is a plan view of the flexible flap of the body assembly;

DETAILED DESCRIPTION OF THE INVENTION

Figure 1:
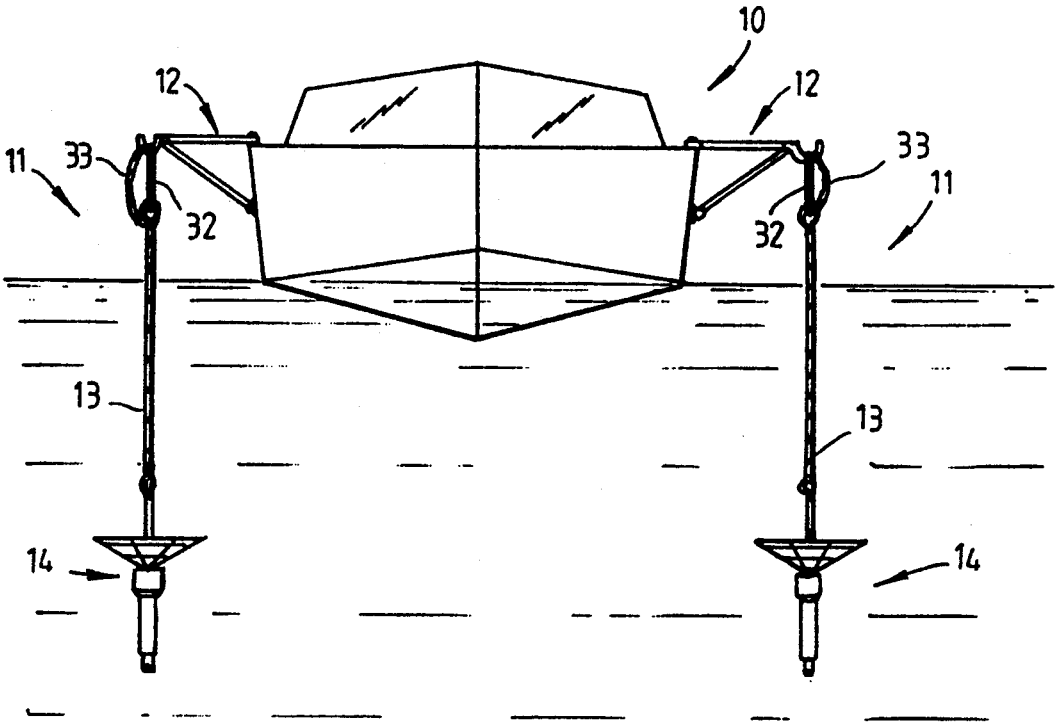
FIG. 1 illustrates a watercraft fitted with stabilizing apparatus in an operative attitude according to the invention.

Referring to the drawings and firstly to FIG. 1, there is illustrated a watercraft 10 fitted with stabilizing apparatus 11 according to the present invention arranged on opposite sides of the craft 10 as shown. Each stabilizing apparatus 11 as shown more clearly in FIG. 2 includes a braced arm assembly 12 mounted to the watercraft 10 and supporting at its free end via a tether 13 a submerged stabilizing body assembly 14 which is constructed to have a high resistance to water in the upward direction and a low resistance to water in the opposite direction so as to sink rapidly in use.

Figure 2:
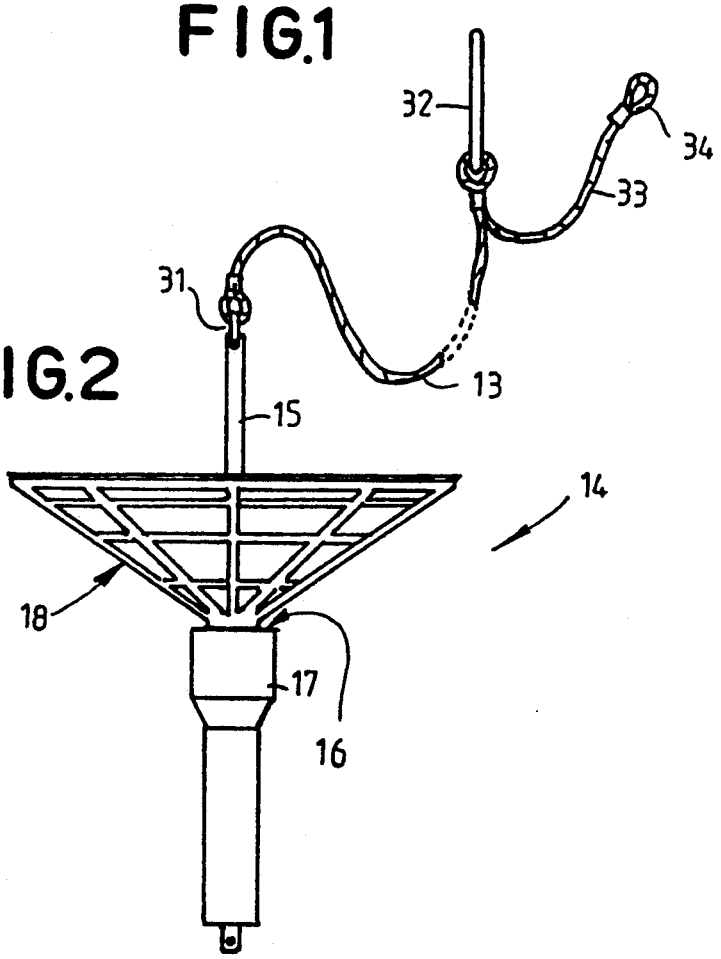
FIG. 2 illustrates in elevational view the submersible body assembly of the stabilizing apparatus.

As shown in FIGS. 2 and 3 each submersible body assembly 14 includes a supporting spindle 15 provided at one end with a heavy weight 16 preferably formed of lead and being in the embodiment illustrated disposed within a stepped cylindrical outer housing 17. Supported coaxially on the spindle 15 is a generally dish-shaped body 18 which is in the form of an open grid of octagonal cross section and defined by eight grid panels 19 each being formed by a plurality of spaced apart generally parallel members 20 defining openings 21 therebetween. As shown the panels 18 taper in width to a central apertured mounting member boss 22 for engagement over the spindle 15. The members 20 may comprise stainless steel rod and the body formed by interconnecting by welding respective rods, however, the body 18 may as a whole be constructed in one piece as a metal such as an aluminium casting, suitably an aluminium casting.

Arranged coaxially about the spindle 15 is a flexible flap member 23 which normally seats within the concavity of the body 18 to substantially conform to the concavity thereof. The flap member 23 as shown more clearly in FIG. 4 is slit radially at circumferentially spaced positions 24, the slits terminating short of a central opening 25 in the member 23 to define in the member 23 a plurality of interconnected leaves or flaps 26 which normally overlap each other and block the apertures 21.

The flap assembly member 23 is retained on the spindle 15 by means of a washer assembly 27 placed over the spindle 15 and a pin 28 inserted through an aperture 29 in the spindle 15 retains the washer assembly 27 on the spindle 15 and the flap member 24 adjacent the body 18 with the member 24 being slightly compressed between the washer 27 and the end wall of the housing 17. The free end of the spindle 15 is aperture at 30 so that the tether 13 may be secured thereto by means of a conventional shackle 31 and at the opposite end, the tether 13 is secured to a rubber ring 32 for engagement with the arm assembly 12. The tether 13 also includes an extended securing portion 33 which terminates in a loop 34 for a purpose which will hereinafter become apparent.

Figure 5:
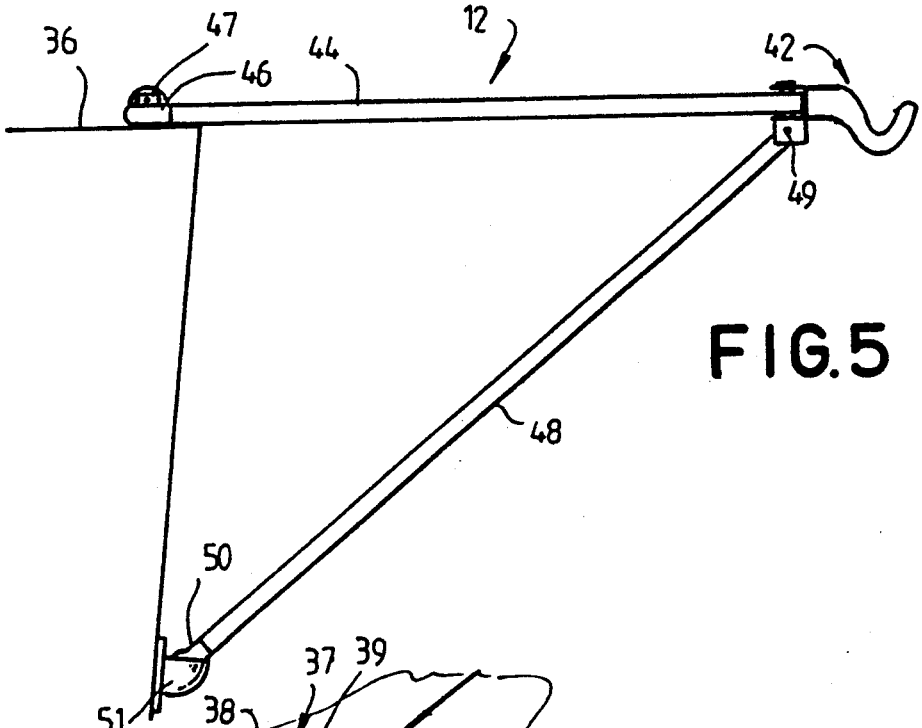
FIG. 5 is an elevational view of the mounting arm assembly for the apparatus mounted to a watercraft.
Figure 6:
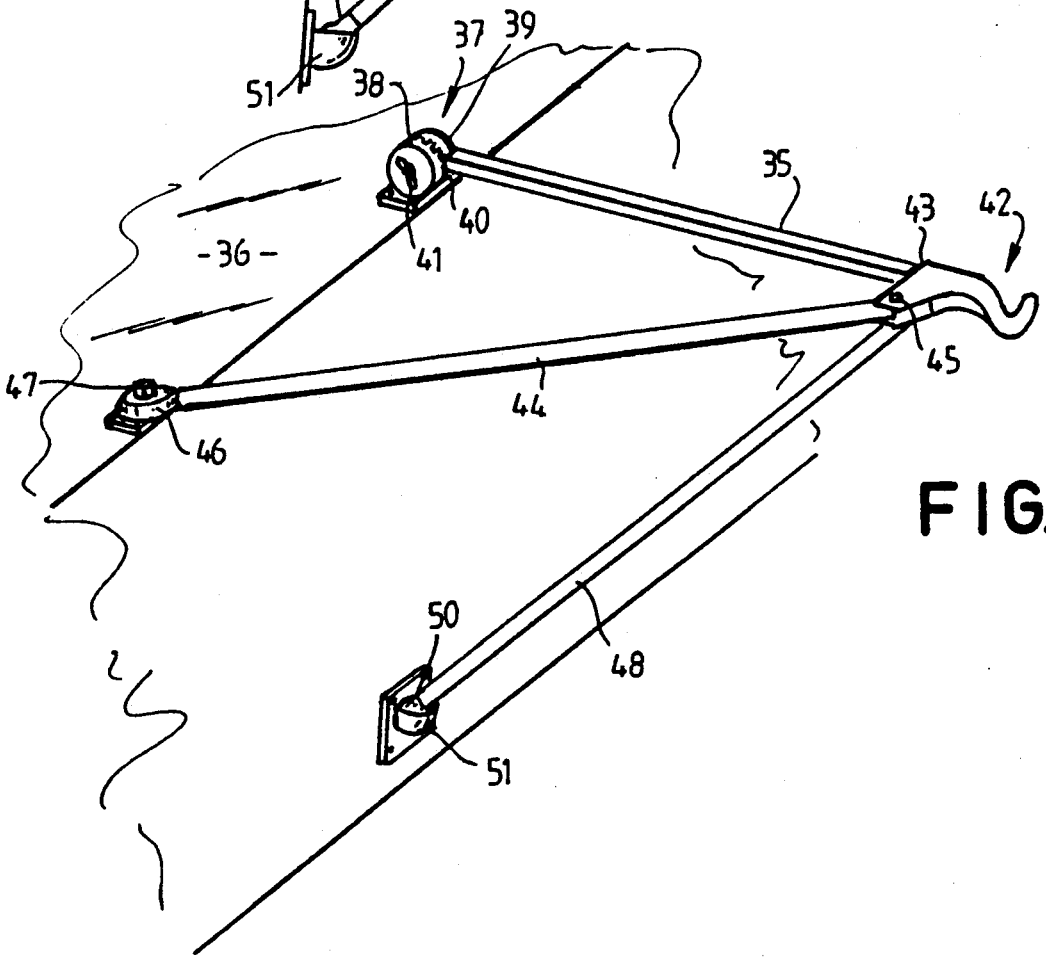
FIG. 6 is a perspective view of the mounting arm assembly.

The arm assembly 12 as shown in FIGS. 5 and 6 includes a first arm 35 which at one end is pivotally mounted to the deck 36 of the watercraft by means of an adjustable pivot connection 37 which comprises first and second co-operable parts 38 and 39, the part 38 being deck mounted and the other part 39 being secured to the end of the arm 35. The respective parts 38 and 39 are provided with complimentary interlocking teeth 40 and are arranged to be clamped together by means of a thumb screw 41 in a desired angular relationship to each other. The opposite end of the arm 35 is engaged with a hook member 42 through a socket connection 43.

A further arm 44 is pivotally mounted at one end at 45 to the hook member 42 for movement about a generally vertical axis and provided with an eye 46 at its opposite end for engagement over an upstanding spigot 47 secured to the deck 36 of the craft 10. The arm 44 braces the arm assembly 12 in the fore and aft direction.

A further arm 48 is pivotally secured at one end at 49 to the hook member 42 and provided with a ball 50 at its opposite end for seating within a socket member 51 secured to the side of the hull of the craft 10. The arm 48 braces the arm assembly 12 in the vertical direction.

The arm assembly 12 may simply be collapsed by releasing the eye 46 from the spigot 47 and disconnecting the parts 38 and 39 after which the respective arms 44 and 48 may be pivoted towards the member 30 so as to be juxtaposed therewith and provide for each storage.

In the inoperative position of the stabilizing apparatus 10, the arm assemblies 12 are removed and stored. After the craft 10 is anchored or moored in an area where stabilization is required, the arm assemblies 12 are assembled as shown in FIGS. 1, 5 and 6, the rings 32 and loops 34 engaged over the hook member 37 and the body assemblies 14 lowered to an extent allowed by the tethers 13.

Figure 7:
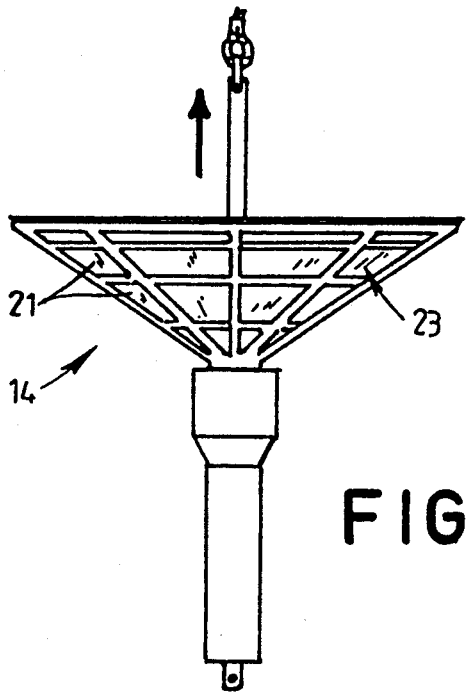
FIGS. 7 and 8 illustrate the operation of the body assembly.

During rolling motion of the watercraft 10 in a swell or chop, the submersed body assembly 14 on one side of the craft 10 will be lifted upwardly whilst the body 14 on the opposite side of the craft 10 will sink. Upward movement of the body assembly 14 however as shown in FIG. 7 will be resisted due to the fact that the flap member 23 will close the apertures 21 in the body 18 so that water is trapped in the cavity of the body 18 acting in the manner of a drogue. Downward or sinking movement of the body assembly 14 when released will occur rapidly under the influence of the weighted housing 17 due to the fact that the flap member 23 moves away from the apertures 21 in the manner shown in FIG. 7 so that water can flow through the apertures 21. Any shock loadings executed by the body assembly 14 will be damped by the resilient nature of the rings 32 which will tend to resiliently deflect upon loading being provided thereto. The securing portion 33 serves as a security device to prevent loss of the body assembly 14 should the ring 32 become detached from the hooked member 42.

Figure 8:
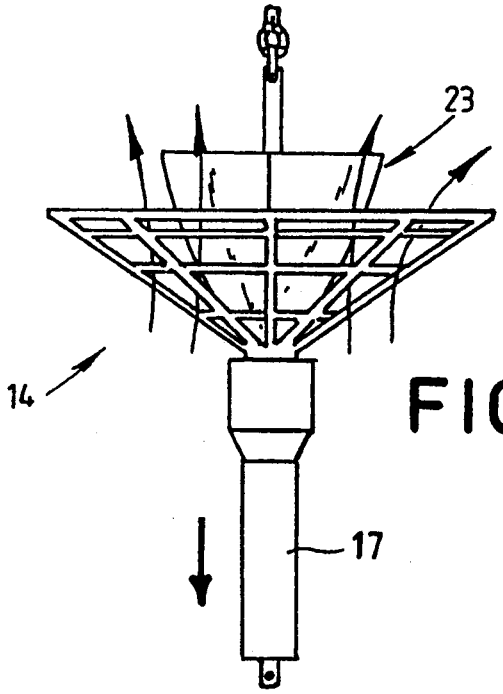

Assuming that a watercraft 10 is undergoing a rolling motion, opposite sides of the craft will alternatively rise and fall. On the side that is rising, the body assembly 14 is in the position of FIG. 7 resisting the upward movement whilst on the opposite side, the body assembly is in the FIG. 8 position falling rapidly. This will occur alternatively on opposite sides substantially damping the rolling motion of the watercraft 10.

The stabilizing apparatus 11 may also be used to dampen pitching of the craft 10 and in this instance, the arm assemblies 12 may be disposed at the bow and stern of the craft. Only one stabilizing apparatus at either side of the craft or at the stern or bow may be used and it will be apparent that many different constructions of body assembly 14 may be employed for achieving the objects of the apparatus. For example, the body 18 may comprises a concave body of circular cross section with the apertures 21 defined by a plurality of circular or other shaped apertures formed in the body wall. Preferably, the flap member 23 is constructed of a rubberized material. Alternatively a water impervious fabric-like material such as a synthetic sheet material may be employed. Other configurations may also be employed to open to allow the body assembly 14 to sink rapidly but to close to resist upward movement of the body assembly.

The size of the body assemblies 14 may be varied to suit the size of watercraft to which the stabilizing apparatus is to be applied and similarly the arm assembly 12 may be considerably varied in design to suit larger vessels.

The body 18 may have many different designs and for example may simply comprises an annular member or other generally planar apertured or grid-like member extending radially of the spindle 15.

In a further form, the rings 32 may be eliminated and resilience provided by the arm assembly 12 which may be constructed of a resiliently diffectable material for this purpose. The arm assembly 12 may also be pivotally mounted to the deck so as to be swung out to extend laterally thereof.

Whilst the above has been given by way of illustrative embodiment of the invention, all of such variations and modifications as would be apparent to persons skilled in the art are deemed to fall within the broad scope and ambit of the invention as defined in the appended claims.

I claim:

1. Apparatus for stabilizing a watercraft, said apparatus comprising a submergible body assembly including body means having a plurality of openings therein; a central spindle; weight means at one end of said spindle; means at the opposite end of said spindle for coupling said body assembly to a tether, whereby said body assembly may be suspended from a watercraft; and closure means on the operative upper side of said body means adapted to close said openings to prevent liquid flow through said body means upon movement of said body means in a first direction, whereby to dampen movement of said watercraft, said closure means moving away from said openings to permit flow of liquid through said body means upon movement of said body means in a direction opposite said first direction.

2. Apparatus according to claim 1 wherein said body means defines on one side a concavity, said closure means comprising flexible flap means adapted for location within said concavity.

3. Apparatus according to claim 2 wherein said body means comprises a grid structure, said grid structure defining said openings in said body means.

4. Apparatus according to claim 3 wherein said grid structure is defined by a plurality of grid panels, each said grid panel having a plurality of parallel elements defining said openings therebetween.

5. Apparatus according to claim 2, wherein said flexible flap means is defined by a flexible member having a plurality of slits or slots therein extending inwardly from the periphery of said flexible member so as to define therebetween a plurality of flap members, said flap members overlapping each other adjacent said slits or slots when said flap means closes said openings.

6. A watercraft including stabilizing apparatus as defined in claim 1.

7. Apparatus according to claim 1 and including resilient means between said watercraft and said body assembly for dampening shock loadings applied by said body assembly.

8. Apparatus according to claim 1 and including an arm assembly adapted to be mounted to said watercraft to extend laterally thereof, said body assembly being suspended from said arm assembly.

9. Apparatus for stabilizing a watercraft comprising a submergible body assembly adapted to be suspended from said watercraft, said body assembly including a body concave on its upper side to define a cavity and having a plurality of openings therein; means for suspending said body from a watercraft so that said body is arranged substantially horizontally; weight means arranged centrally of said body on the underside thereof, and flexible flap means located on the upper side of said body and within said cavity, said flap means being adapted to close said openings to prevent liquid flow through said body upon movement of said body in a first direction so as to dampen movement of said watercraft and being adapted to permit flow of liquid through said body upon movement of said body means in a direction opposite said first direction.

10. Apparatus according to claim 9, wherein said flexible flap means comprises a flexible member having a plurality of slits or slots therein extending inwardly from the periphery of said flexible member so as to define a plurality of flaps means, said flap members overlapping each other adjacent said slits or slots when said closure means closes said openings.

11. Apparatus for stabilizing a water craft, said apparatus including a submergible body assembly adapted to be suspended from said watercraft, said body assembly including a central spindle, a body arranged coaxially on said spindle, said body being generally concave on its upper side and having a plurality of openings therethrough, flexible flap means within said concavity of said body and normally closing said openings and weight means for weighting said body assembly, said flap means preventing flow of water through said body means in a first direction but moveable away from said openings to permit flow of water through said body means in the opposite said direction.

12. Apparatus according to claim 11, wherein said weight means comprises a wight arranged centrally on the underside of the said body.

13. Apparatus according to claim 11, including an arm assembly adapted to be mounted to said watercraft to extend laterally thereof, said body assembly being adapted to be suspended from said arm assembly.

14. Apparatus according to claim 13, wherein said arm assembly includes a first arm adapted to be mounted at one end of said watercraft to extend laterally outwardly therefrom and support means at the outer end of said first arm from which said body assembly may be suspended.

15. Apparatus according to claim 14, wherein said arm assembly includes a second arm extending from said said support means at an angle to said first arm to brace said first arm against movement in a longitudinal direction.

16. Apparatus according to claim 15, including a third arm extending downwardly from said support means at an angle to said first arm to brace said first arm in a vertical direction.

17. Apparatus for stabilizing a watercraft comprising a submergible body assembly adapted to be suspended from said watercraft, said body assembly including a body having a plurality of openings therein; a central spindle, means for coupling said spindle to a tether whereby said body assembly may be suspended from a watercraft so that said body is arranged substantially horizontally weight means arranged centrally of said body on the underside thereof, and closure means located on the upper side of said body, said closure means being adapted to close said openings to prevent liquid flow through said body upon movement of said body in a first direction so as to dampen movement of said watercraft and being adapted to permit flow of liquid through said body upon movement of said body means in a direction opposite said first direction.

18. Apparatus according to claim 17, wherein said body is of grid form.

19. A watercraft including a pair of stabilizing apparatus suspended from opposite sides of said watercraft, each said stabilizing apparatus including a body having a plurality of openings therein, said body being arranged substantially horizontally; weight means arranged centrally of said body on the underside thereof, and closure means located on the upper side of said body, said closure means being adapted to close said openings to prevent liquid flow through said body upon movement of said body in a first direction so as to dampen movement of said watercraft and being adapted to permit flow of liquid through said body upon movement of said body means in a direction opposite said first direction.

20. A watercraft according to claim 19, including a pair of arm assemblies extending laterally from opposite sides of said watercraft from which said body assemblies of each said stabilizing apparatus are respectively suspended.

21. Apparatus according to claim 20, wherein each said arm assembly includes a first arm mounted at one end to said water craft to extend laterally outwardly therefrom and support means at the outer end of said first arm from which a said body is suspended.

22. Apparatus according to claim 21, wherein said arm assembly includes a second arm extending from said support means at an angle to said first arm to brace said first arm against movement in a longitudinal direction.

23. Apparatus according to claim 22, including a third arm extending downwardly from said support means at an angle to said first arm to brace said first arm in a vertical direction.

24. Apparatus according to claim 20, wherein said body assemblies are supported via resilient means from said arm assemblies.

* * * * *